US006971733B2

(12) United States Patent
Suzuki

(10) Patent No.: US 6,971,733 B2
(45) Date of Patent: Dec. 6, 2005

(54) INK JET RECORDING APPARATUS

(75) Inventor: Kazunaga Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 76 days.

(21) Appl. No.: 10/759,276

(22) Filed: Jan. 20, 2004

(65) Prior Publication Data

US 2004/0145622 A1 Jul. 29, 2004

Related U.S. Application Data

(63) Continuation of application No. 09/836,284, filed on Apr. 18, 2001.

(30) Foreign Application Priority Data

Apr. 18, 2000 (JP) ..... P.2000-116798
Apr. 10, 2001 (JP) ..... P.2001-111811

(51) Int. Cl.[7] ..... B41J 2/165
(52) U.S. Cl. ..... 347/27; 347/23; 347/30
(58) Field of Search ..... 347/23–35

(56) References Cited

U.S. PATENT DOCUMENTS 3,925,788 A 12/1975 Kashio
5,428,380 A 6/1995 Ebisawa et al.
5,475,404 A 12/1995 Takahashi et al.
5,805,180 A 9/1998 Ebisawa et al.
6,024,432 A * 2/2000 Aruga et al. ..... 347/23
6,036,299 A * 3/2000 Kobayashi et al. ..... 347/30
6,174,038 B1 1/2001 Nakazawa et al.
6,357,846 B1 3/2002 Kitahara
6,685,300 B1 * 2/2004 Ishiyama et al. ..... 347/23

FOREIGN PATENT DOCUMENTS

EP 0 829 354 B1 3/1998
EP 1106360 A1 * 6/2001 ..... B41J 2/165
JP 60-248357 A 12/1985
JP 5-318718 A 12/1993
JP 7-290720 A 11/1995
JP 9-29996 A 2/1997
JP 9-193378 A 7/1997
JP 9-226116 A 9/1997
JP 9-295411 11/1997
JP 10-095132 4/1998
JP 11-192723 A 7/1999

OTHER PUBLICATIONS

Patent Abstracts of Japan Apr. 14, 1998, 10-095132.

* cited by examiner

*Primary Examiner*—Stephen D. Meier
*Assistant Examiner*—Ly T. Tran
(74) *Attorney, Agent, or Firm*—Sughrue Mion, PLLC

(57) ABSTRACT

A pressure generator is driven to eject ink droplets from a nozzle orifice such that a plurality of flushing operations are intermittently repeated with a first time interval, when a recording operation of a recording head is not performed. Each flushing operation includes a plurality of ink ejections repeated for a predetermined times with a second time interval which is shorter than the first time interval. The ink near the nozzle orifice is residually vibrated between the flushing operations, so that the viscous ink is diffused and the viscous ink is effectively expelled.

13 Claims, 5 Drawing Sheets

FIG. 5
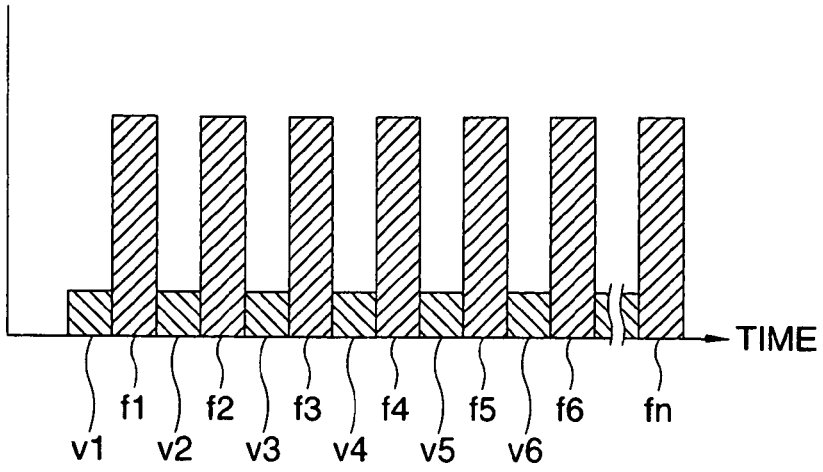
FIG. 6A
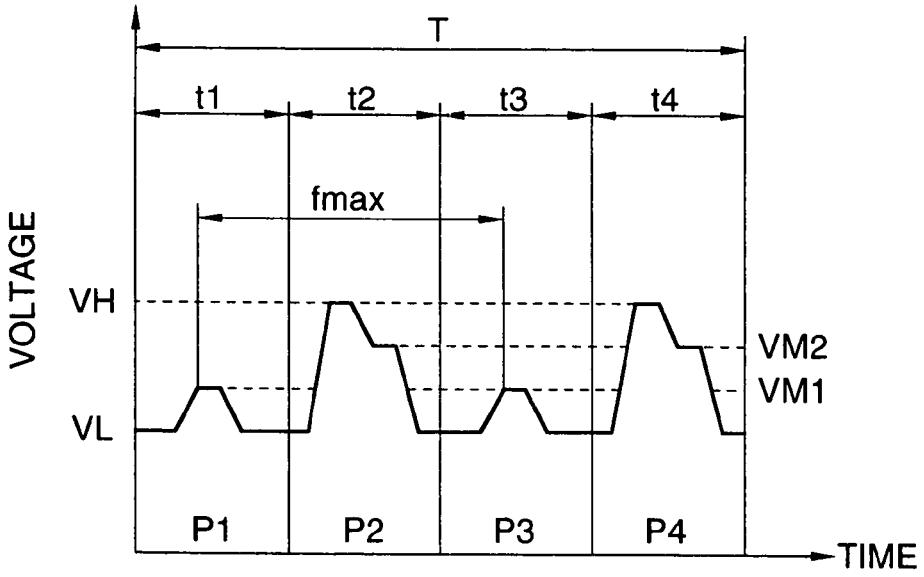
FIG. 6B
| | P1 | P2 | P3 | P4 |
|---|---|---|---|---|
| MENISCUS VIBRATING OPERATION | ○ | — | ○ | — |
| FLUSHING OPERATION | — | ○ | — | ○ |

FIG. 7
| STAND-BY TIME PERIOD(SEC) | VIBRATING NUMBER | FLUSHING NUMBER | |
|---|---|---|---|
| | | BRACK INK | COLOR INK |
| 0 – 2 | 100 | 200 | 50 |
| 2 – 12 | 1000 | 400 | 100 |
| 12 – | CAPPED STAND-BY | | |
FIG. 8
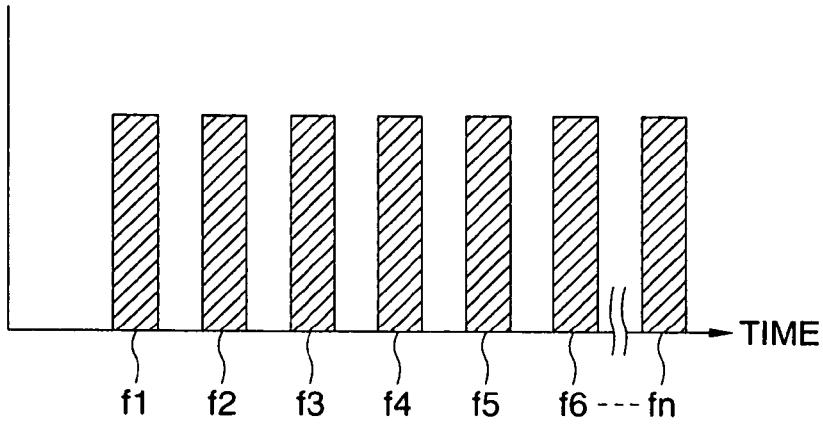
FIG. 9
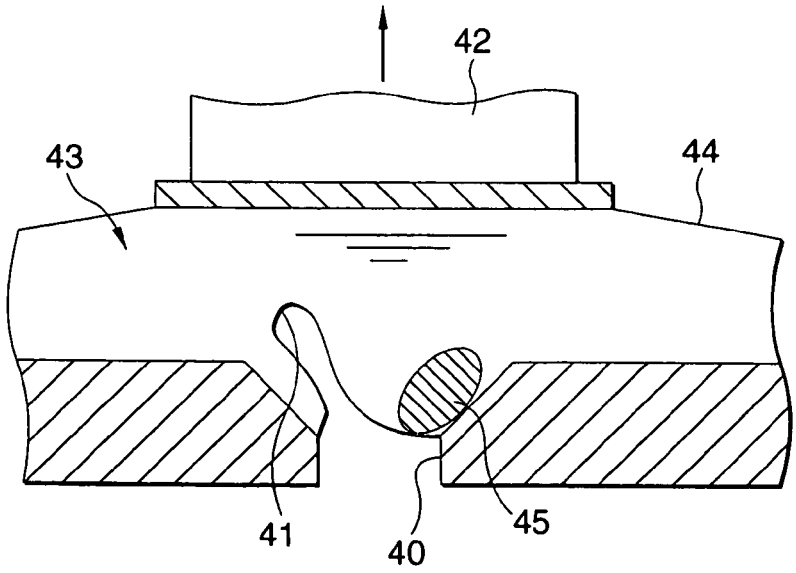

INK JET RECORDING APPARATUS

This is a continuation of application Ser. No. 09/836,284 filed Apr. 18, 2001; the disclosure of which is incorporated herein by reference.

BACKGROUND OF THE INVENTION

The present invention relates to an ink jet recording apparatus having an ink jet recording head for ejecting ink droplets in accordance with the print data and forming the dots on the recording medium.

Generally, an ink jet recording head (hereinafter referred to as a "recording head") comprises a plurality of nozzle orifices, a pressure generating chamber in communication with each nozzle orifice, and a piezoelectric vibrator for varying the pressure of the pressure generating chamber. And the recording head ejects the ink of the pressure generating chamber as ink droplets through nozzle orifices owing to a pressure change within the pressure generating chamber caused by vibrating the piezoelectric vibrator in accordance with a print signal.

In the recording apparatus employing the above recording head, the recording head is mounted on a carriage capable of reciprocating in a main scanning direction, and ejects ink droplets onto the recording sheet while reciprocating in a widthwise direction of the recording sheet, thereby printing an image or character through use of a dot matrix onto the recording sheet.

In nozzle orifices ejecting ink droplets successively during the printing operation, since new ink are successively supplied thereto clogging is hardly occurred. However, in the nozzle orifices located at the upper end or lower end to eject ink droplets less frequently the ink is dried and become viscous near the nozzle orifices while printing possibly causing the clogging. From the time when the recording head is reciprocated once to make the printing to the time when the print data corresponding to one reciprocation is input, the recording head is enabled to stand by at the stand-by position, but the drying of the ink progresses while the stand-by, giving rise to an ejection failure such as flight curvature because the viscous ink resides near the nozzle orifices.

To deal with such a problem, a "flushing" for expelling the viscous ink near the nozzle orifices to prevent an occurrence of print failure is performed by applying a drive signal irrespective of the print data to the piezoelectric vibrator at a start timing of printing after the print data is entered in the stand-by state, as one of the preliminary operations for starting the printing.

However, in the related ink jet recording apparatus, since the flushing operation is performed successively, a part of the viscous ink near the nozzle orifices is expelled by flushing to make a clear portion, and the ink is successively ejected through the clear portion, so that the viscous ink residing around the clear portion is difficult to expel effectively. In this state, a meniscus 41 is intruded deeply and obliquely to avoid a viscous ink lump 45, and is not recovered sufficiently, making the behavior of the meniscus 41 extremely unstable and causing a flight curvature on subsequent ejecting it being apprehended that the stable ejection characteristics can not be obtained as shown in FIG. 9. If the meniscus 41 is intruded deeply and obliquely it is also apprehended that a bubble is entered into the nozzle orifice 40 to prevent ejecting of ink droplets. In this figure, pressure generating chamber 43 is in communication with a nozzle orifice 40. A vibration plate 44 makes up a part of the pressure generating chamber 43. A piezoelectric vibrator 42 is provided for vibrating the vibration plate 44

SUMMARY OF THE INVENTION

The present invention has been achieved in the light of the aforementioned problems, and it is an object of the invention to provide an ink jet recording apparatus that is capable of expelling the viscous ink around the nozzle orifices efficiently.

In order to achieve the above object, according to the present invention, there is provided an ink jet recording apparatus, comprising:

a recording head including a nozzle orifice communicated with a pressure generating chamber;

a pressure generator, which varies pressure of ink in the pressure generating chamber; and a controller, which drives the pressure generator to eject ink droplets from the nozzle orifice such that a plurality of flushing operations are intermittently repeated with a first time interval, when a recording operation of the recording head is not performed, each flushing operation including a plurality of ink ejections repeated for a predetermined times with a second time interval which is shorter than the first time interval.

In this configuration, in a series of flushing operations (hereinafter referred to as an "intermittent flushing operation"), the ink residing near the nozzle orifice is vibrated between the flushing operations, so that the viscous ink is diffused and the viscous ink is effectively expelled. Accordingly, an unstable ejection such as flight curvature is unlikely to occur in the subsequent ejecting, and an ejection failure caused by the bubbles entering the nozzle orifice is less likely to occur.

Preferably, an ejection frequency in a final flushing operation is higher than an ejection frequency in an initial flushing operation. More preferably, an ejection frequency in a latter flushing operation is higher than an ejection frequency in a former flushing operation.

In this configuration, the successive ejection is made at a relatively low frequency while a quantity of viscous ink resides near the nozzle orifice, whereby the viscous ink can be expelled without causing an abrupt variation of meniscus to prevent the bubble from entering the nozzle orifice. And after the viscous ink is expelled to some extent, the residual viscous ink is surely expelled at a relatively high frequency to prevent an ejection failure from occurring owing to the viscous ink remaining.

Preferably, the repeated number of ink ejection in a final flushing operation is greater than the repeated number of ink ejection in an initial flushing operation. More preferably, the repeated number of ink ejection in a latter flushing operation is greater than the repeated number of ink ejection in a former flushing operation.

In this configuration, the flushing operation is made at a relatively small number of ejecting ink droplets while a quantity of viscous ink resides near the nozzle orifice, to expel the viscous ink gradually. And after the viscous ink is expelled to some extent, the residual viscous ink is surely expelled at a relatively high frequency to prevent an ejection failure from occurring owing to the viscous ink remaining.

Preferably, the controller drives the pressure generator to vibrate a meniscus of ink in the nozzle orifice between the respective flushing operations.

In this configuration, the viscous ink near the nozzle orifices is further diffused between each flushing operation and more easily expelled, so that the viscous ink remaining near the nozzle orifices can be expelled quite effectively.

More preferably, the meniscus of ink is vibrated such an extent that an ink droplet is not ejected from the nozzle orifice.

In this configuration, the ink is not consumed wastefully to resolve the clogging, the effective amount of ink for use in printing can be increased, and the waste liquid volume can be suppressed or reduced.

Also, it is preferable that the pressure generator is driven at the maximum driving frequency thereof to vibrate the meniscus of ink.

In this configuration, the viscous ink is rapidly diffused and expelled effectively, because the diffusion of viscous ink due to meniscus vibration is proportional to the displacement speed of meniscus.

Still also, it is preferable that the controller drives the pressure generator to vibrate a meniscus of ink in the nozzle orifice before an initial flushing operation is performed.

In this configuration, because the viscous ink near the nozzle orifices is diffused in advance to some extent and then the intermittent flushing is performed, the viscous ink can be expelled effectively.

Preferably, the recording head performs the recording operation while moving in a main scanning direction. The flushing operations are performed when the recording head is in a stand-by state which is defined as a time period from when the recording head stops moving to when the recording head starts moving.

In this configuration, it is possible to expel effectively the viscous ink around nozzle orifices produced in a short term while scanning the recording head, or from the scan stop to the next scan start.

Here, it is preferable that the ink jet recording apparatus further comprises a timer, which measures a time period of the stand-by state. The repeated number of ink ejections in the respective flushing operation is determined in accordance with the measured stand-by time period.

In this configuration, the viscous ink can be surely expelled in accordance with the degree of viscosity in the stand-by state, so that the wasteful consumption of the ink can be suppressed.

Also, it is preferable that a vibrating number is determined in accordance with the measured length of the stand-by time period.

In this configuration, the viscous ink can be diffused and expelled efficiently in accordance with the degree of viscosity in the stand-by state.

Also, it is preferable that the repeated number of ink ejection in the respective flushing operations is determined in accordance with the type of ejected ink.

In this configuration, the viscous ink can be surely expelled in accordance with the kind of ink to be ejected or the degree of viscosity such as increasing the repeated number of ink ejection for the ink that is more likely to be viscous, whereby the wasteful consumption of ink can be suppressed.

Also, it is preferable that a vibrating number of the pressure generator is determined in accordance with the type of ejected ink.

In this configuration, the viscous ink can be diffused and surely expelled in accordance with the kind of ink to be ejected or the degree of viscosity such as increasing the vibrating number for the ink that is more likely to be viscous.

Preferably, the pressure generator is a piezoelectric vibrator which changes the volume of the pressure generating chamber to vary the pressure of ink therein.

In this configuration, the pressure of ink in the pressure generating chamber can be changed by controlling the drive voltage or waveform of the piezoelectric vibrator, so that the intricate control for pressure changes in the flushing operation or meniscus vibrating operation can be easily made.

Preferably, the controller includes: a drive signal generator, which generates a common drive signal including a flushing waveform configured to perform an ink ejection and a meniscus vibrating waveform configured to vibrate a meniscus of ink in the nozzle orifice; and a drive waveform selector, which applies the flushing waveform and the meniscus vibrating waveform selectively to the pressure generator.

In this configuration, the recording apparatus is not elaborate with easy control, because the drive waveforms for both the flushing and meniscus vibrating operations can be produced with one drive signal from one drive signal generator.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIG. 5 is an explanatory view showing a flushing operation according to a first embodiment of the invention;

FIG. 6A is a waveform diagram showing one example of a drive signal generated in a drive signal generator shown in FIG. 4;

FIG. 6B is a diagram showing one example of selection executed by a drive waveform selector shown in FIG. 4;

FIG. 7 is a diagram showing examples of operation conditions for the flushing operation and a meniscus vibrating operation;

FIG. 8 is an explanatory view showing a flushing operation according to a second embodiment of the invention; and FIG. 9 is an explanatory view illustrating the state of a meniscus during a flushing operation in a related ink jet recording apparatus.

DETAILED DESCRIPTION OF THE PREFERRED EMBODIMENTS

The preferred embodiments of the present invention will be described in detail with reference to the accompanying drawings.

Figure 1:
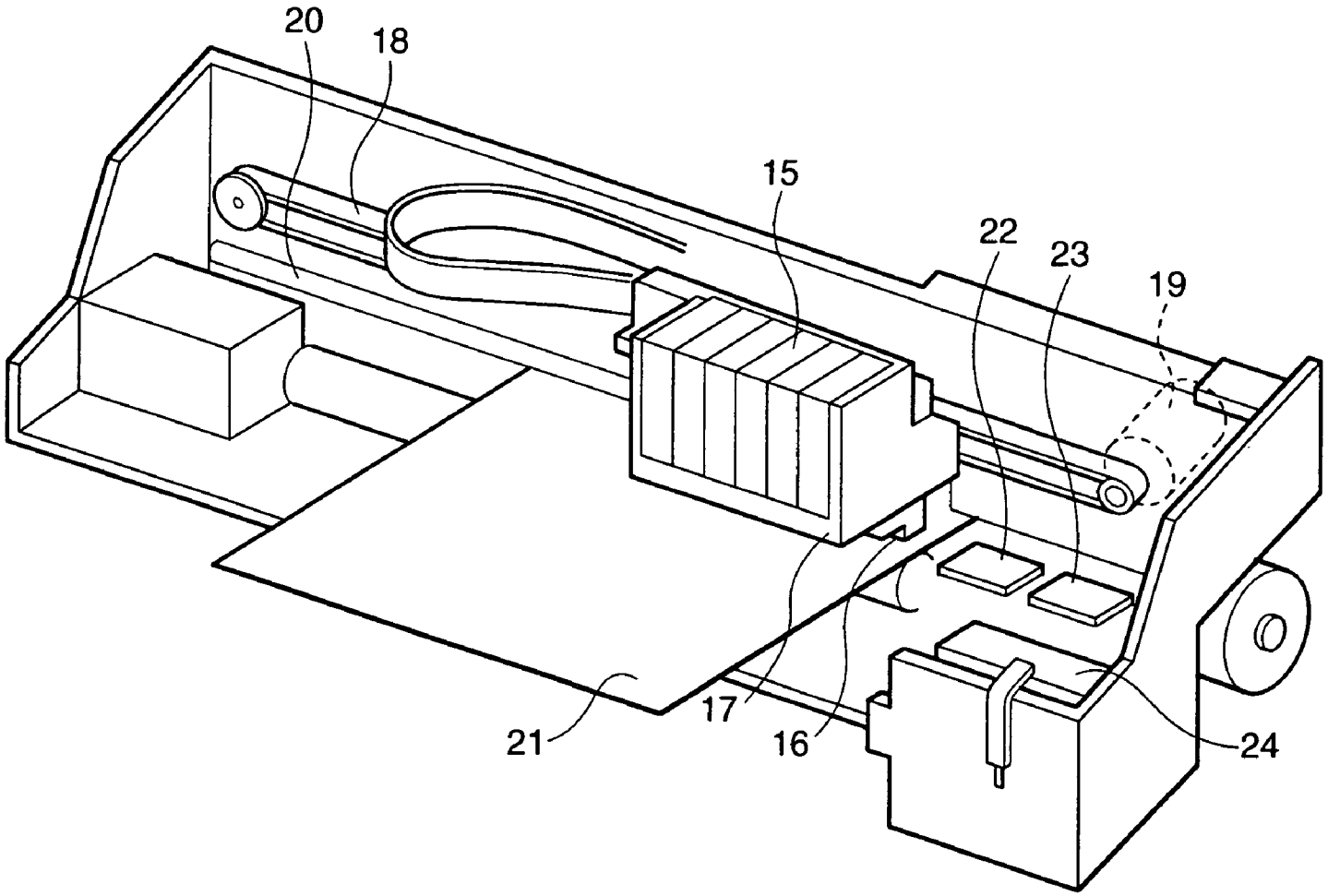
FIG. 1 is a perspective view illustrating an example of an ink jet recording apparatus of the present invention.

FIG. 1 illustrates an example of an ink jet recording apparatus. This apparatus comprises a carriage 17 with an ink cartridge 15 mounted thereon and a recording head 16 attached on a bottom face of the carriage 17.

The carriage 17 is connected to a stepping motor 19 via a timing belt 18, and reciprocated in a widthwise direction of the recording sheet 21 (main scanning direction), while being guided by a guide bar 20. Also, the carriage 17 has the recording head 16 on an opposite face (bottom face in this example) to the recording sheet 21. And the ink from the ink cartridge 15 is supplied into this recording head 16, which ejects ink droplets on the upper face of the recording sheet 21 while moving the carriage 17, thereby printing an image or character on the recording sheet 21 through use of a dot matrix.

Figure 2:
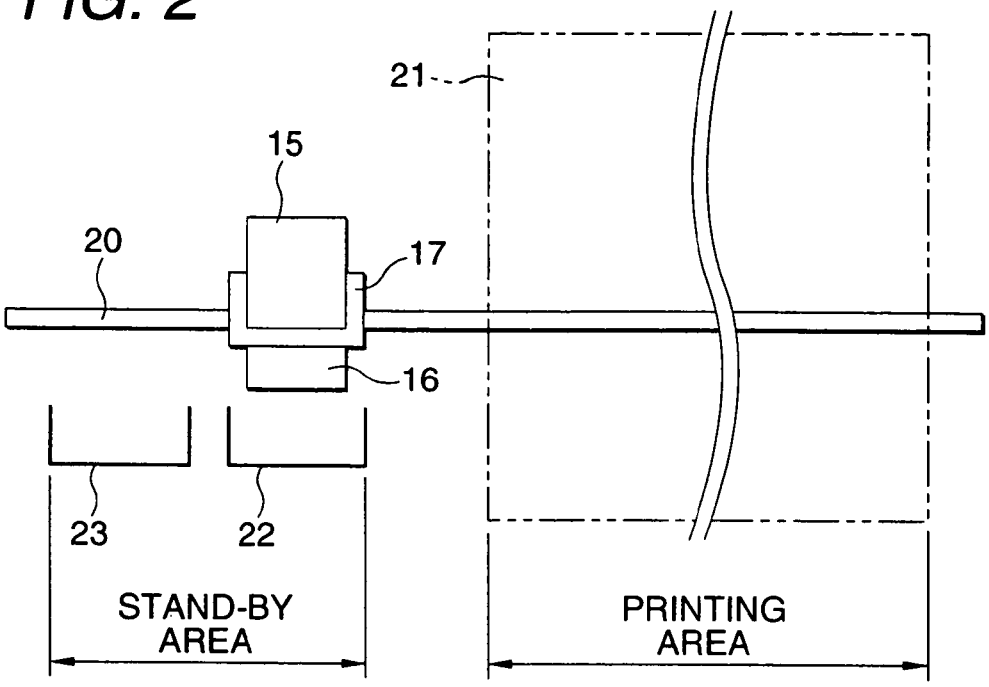
FIG. 2 is an explanatory view illustrating essential parts of the ink jet recording apparatus.

In a stand-by area within the movement range of the carriage 17, there is provided a flushing box (ink receiver) 22 that is a vessel for receiving ink droplets ejected from the recording head 16 by flushing, as shown in FIG. 2. Outside the flushing box 22, a cap 23 is provided adjacent the flushing box 22 to prevent the nozzle orifices from drying as possible by sealing the nozzle orifices of the recording head 16 during the print rest. This cap 23 is connected to a suction pump 24, to suck the ink from the nozzle orifices by applying a negative pressure to the nozzle orifices of the recording head 16 during the cleaning.

The recording head 16 is mounted on the carriage 17, and starts to move from a suspend state where it is positioned in the stand-by area to perform the printing by reciprocating over a print area on the recording sheet 21. And with the recording apparatus, the recording head 16 returns to a location of the flushing box 22, to stop the movement for a while, every time the printing of one reciprocation is ended, whereby the recording head 16 waits for the print data of next one reciprocation to be accumulated. In the case where the stand-by time is longer, the recording head 16 returns to a location of the cap 23, and stands by in a state where the nozzle orifices are sealed with the cap.

Figure 3:
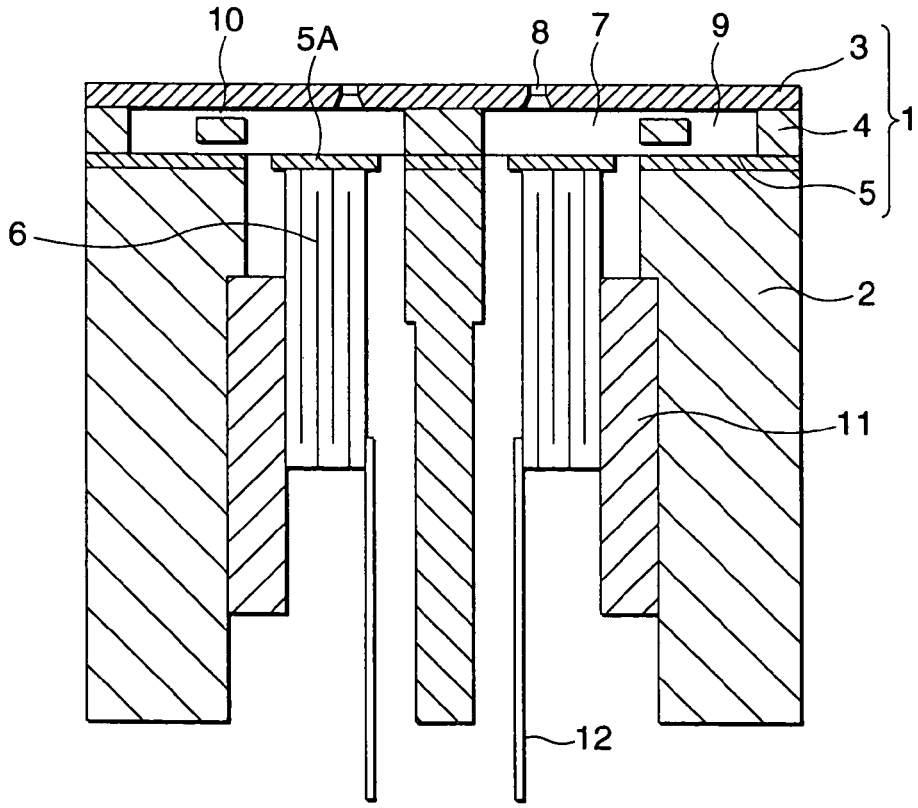
FIG. 3 is a cross-sectional view illustrating an example of an ink jet recording head.

FIG. 3 illustrates an example of the recording head 16 employing the piezoelectric vibrator 6 for use with the recording apparatus. This recording head 16 has an ink channel unit 1 formed with the nozzle orifices 8 and the pressure generating chamber 7 and a head case 2 for accommodating the piezoelectric vibrator 6, bonded together.

The ink channel unit 1 is constituted by a nozzle plate 3 with the nozzle orifices 8 bored, a channel forming plate 4 formed with a space corresponding to the pressure generating chamber 7 and a common ink reservoir 9, as well as an ink supply port 10 for communicating them, and a vibrating plate 5 for enclosing an opening of the pressure generating chamber 7, laminated together.

The piezoelectric vibrator 6 is a so-called longitudinal vibration mode vibrator that contracts longitudinally in a charged state by the input of a drive signal, and extends longitudinally during a process of discharging from the charged state. The piezoelectric vibrator 6 has its top end abutted against an island portion 5A of the vibration plate 5 forming a part of the pressure generating chamber 7, with the other end secured to a base board 11.

In the recording head 16, the pressure generating chamber 7 expands or shrinks along with the contraction or elongation of the piezoelectric vibrator 6, to suck the ink owing to a pressure change of the pressure generating chamber 7, and eject ink droplets. In the figure, reference numeral 12 denotes a flexible printed circuit for inputting a drive waveform into the piezoelectric vibrator 6.

Figure 4:
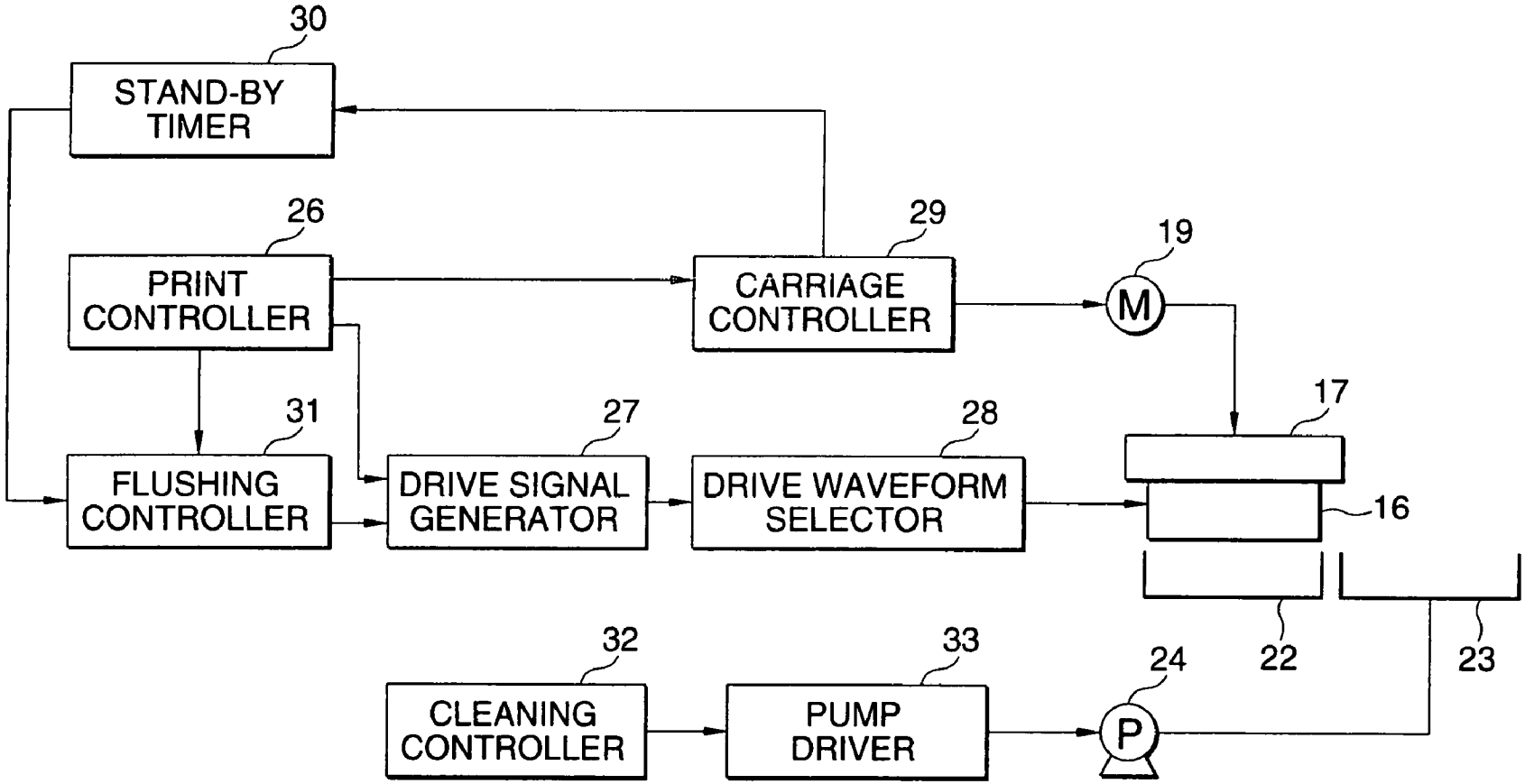
FIG. 4 is a block diagram showing the configuration of the ink jet recording apparatus.

The recording apparatus comprises a print controller 26 for generating bit map data on the basis of a print signal from a host; a carriage controller 29 for controlling the movement of the carriage 17 in the main scanning direction while controlling a stepping motor 19; a drive signal generator 27 for generating a drive signal containing a plurality of drive waveforms on the basis of a signal from the print controller 26; and a drive waveform selector for selecting a drive waveform for driving the piezoelectric vibrator 6 from the drive signal generated by the drive signal generator 27, as shown in FIG. 4.

Also, the recording apparatus comprises a flushing controller 31 for controlling the flushing operation or a meniscus vibrating operation by driving the recording head 16 irrespective of the print data, such as when the recording head 16 starts printing again after the stand-by operation. Further, the recording apparatus comprises a stand-by timer 30 for measuring the stand-by time for which the recording head 16 is left waiting in the stand-by area, the stand-by time being initiated upon detecting that the carriage 17 is reciprocated once to return to the stand-by area.

And in the flushing controller 31, the number of ejected droplets in the flushing operation, or the vibrating number in the meniscus vibrating operation, can be determined by the length of stand-by time measured by the stand-by timer 30. In the figure, reference numeral 32 denotes a cleaning controller for controlling the cleaning while controlling a pump driver 33.

Herein, the flushing operation involves expelling the viscous ink around the nozzle orifices 8 by supplying a drive waveform into the piezoelectric vibrator 6 irrespective of a print signal, and ejecting ink droplets from all the nozzle orifices 8 of the recording head 16. Also, the meniscus vibrating operation involves supplying a drive waveform of a driving voltage to such an extent that ink droplets are not ejected into the piezoelectric vibrator 6, and minutely vibrating the ink within the pressure generating chamber 7 to diffuse the viscous ink and reduce its viscosity.

And in the recording apparatus, when the recording head 16 performs the printing for one reciprocation, returns to the stand-by area, is kept waiting till the print data of the next one reciprocation is accumulated, and starts the printing again, the flushing is performed to expel the viscous ink due to a short interval for which the nozzle orifices 8 are left aside during the reciprocating scan of the recording head 16 or from the scan stop to the next scan start.

The flushing operation involves performing in advance the meniscus vibrating operation during a meniscus vibrating period v1, and repeating alternately flushing periods f1, f2, . . . , and meniscus vibrating periods v2, v3, . . . , thereby executing the flushing periods f1, f2, . . . intermittently, as shown in FIG. 5. Herein, the intermittent flushing operation involves ejecting plural ink droplets successively with a predetermined interval (with a longer period than an ink droplet eject period during the flushing period). In this way, by performing in advance the meniscus vibrating operation v1, the viscous ink near the nozzle orifices 8 is diffused to some extent and more likely to be expelled. Also, by effecting the flushing periods f1, f2, . . . intermittently, and providing the meniscus vibrating periods v2, v3, . . . between flushing periods f1, f2, . . . , the viscous ink near the nozzle orifices 8 is diffused in the meniscus vibrating periods v2, v3, . . . , while the flushing periods f1, f2, . . . are repeated, so that the viscous ink can be expelled quite efficiently.

The time period of each flushing period f1, f2, . . . is set at about 10 msec, and the number of ejected droplets in each flushing period f1, f2, . . . is set at about 50 to 400 shots. Also, the time period of the meniscus vibrating periods v1, v2, . . . is set at about 10 to 100 msec, and the vibrating number in the meniscus vibrating periods v1, v2, . . . is set at about 100 to 1000 times.

In this case, in the flushing periods f1, f2, . . . during the intermittent flushing operation, the flushing drive frequency is preferably set to be higher in the later flushing periods ( . . . , fn−1, fn) than the initial flushing periods (f1, f2, . . . ).

More preferably, the flushing drive frequency is set to be higher in the later flushing periods f2, f3, . . . , such that it is one-tenth the maximum drive frequency in the first flushing period f1, and one-fifth the maximum drive frequency in the second flushing period f2, for example. In this way, while the viscous ink remains near the nozzle orifices 8, the flushing periods f1, f2, . . . are effected at a relatively low drive frequency, whereby the viscous ink can be expelled without causing an abrupt meniscus change to prevent bubbles from entering the nozzle orifices 8. And after the viscous ink is expelled to some extent, it is possible to surely expel the viscous ink residing at a relatively high drive frequency.

In the flushing periods f1, f2, . . . during the intermittent flushing operation, the number of ejected droplets is preferably set to be greater in the later flushing periods fn−1, fn than the initial flushing periods f1, f2. More preferably, the number of ejected droplets is set to be greater in the later flushing periods f2, f3, . . . In this way, while the viscous ink remains near the nozzle orifices 8, the flushing operation is performed at a relatively small number of ejected droplets, thereby expelling the viscous ink gradually. And after the viscous ink is expelled to some extent, it is possible to surely expel the viscous ink residing at a relatively great number of ejected droplets.

Further, the meniscus vibrating periods v1, v2, . . . are effected at the maximum drive frequency, whereby the viscous ink is diffused rapidly and expelled more efficiently, because the diffusion of the viscous ink owing to meniscus vibration is proportional to the displacement rate of the meniscus.

The flushing periods f1, f2, . . . and the meniscus vibrating periods v1, v2, . . . are effected in such a manner that the drive signal generator 27 generates a drive signal containing a meniscus vibration waveform for making the meniscus vibrating operation and a flushing waveform for making the flushing operation, and the drive signal selector 28 selects the meniscus vibration waveform or the flushing waveform from the drive signal.

FIG. 6A illustrates one example of the drive signal that is generated by the drive signal generator 27. This drive signal is composed of four drive waveforms P1, P2, P3 and P4 with different drive timings. The drive waveforms P1 and P3 are meniscus vibration waveforms for effecting the meniscus vibrating operation, and the drive waveforms P2 and P4 are flushing waveforms for effecting the flushing operation.

The drive signal generator 27 generates this drive signal at a certain print period T (e.g., 7.2 kHz=140 $\mu$sec). With the drive signal, the print period T is divided into four periods t1, t2, t3 and t4, each period t1, t2, t3 or t4 involving one drive waveform P1, P2, P3 or P4. The print period T defines the printing speed in the printer.

The meniscus vibration waveforms P1, P3 are composed of a waveform element in which the voltage is increased from the minimum drive voltage VL to a first intermediate voltage VM1 not to cause ink droplets to be ejected, held for a certain time period, and decreased to the minimum drive voltage VL again. The flushing waveforms P2, P4 are composed of a waveform element in which the voltage is increased from the minimum drive voltage VL to the maximum drive voltage VH, held for a certain time period, decreased from the maximum drive voltage VH to a second intermediate drive voltage VM2, held for a certain time period, and decreased to the minimum drive voltage VL again. At this time, the piezoelectric vibrator 6 is charged due to an increase in the drive voltage, and contracted, so that the pressure generating chamber 7 is expanded. Conversely, the piezoelectric vibrator 6 is ejected due to a decrease in the drive voltage, and elongated, so that the pressure generating chamber 7 is contracted.

Accordingly, by supplying the meniscus vibration waveforms P1, P3 into the piezoelectric vibrator 6, the pressure generating chamber 7 vibrates the ink in a range not to eject ink droplets, thereby diffusing the viscous ink. Also, by supplying the flushing waveforms P2, P4 into the piezoelectric vibrator 6, the pressure generating chamber 7 is expanded and filled with the ink due to charging at the first time. Then due to discharging at the next time, the pressure generating chamber 7 is suddenly contracted, causing the ink pressure within the pressure generating chamber 7 to be increased to eject ink droplets from the nozzle orifices 8. Then due to the next discharging, the pressure generating chamber 7 is restored to its original volume.

And in the recording apparatus, when the meniscus vibrating periods v1, v2, . . . are effected, at least one of the drive signals P1, P3 is selected by the drive waveform selector 28 and supplied into the piezoelectric vibrator 6, whereas when the flushing periods f1, f2, . . . for the flushing operation are effected, at least one of the drive signals P2, P4 is selected by the drive waveform selector 28 and supplied into the piezoelectric vibrator 6, as shown in FIG. 6B.

In the above drive waveforms, the period (fmax) of the drive timing for P1 and P3 determines the maximum frequency. When the meniscus vibrating periods v1, v2, . . . or the flushing periods f1, f2, . . . are effected, the flushing periods f1, f2, . . . and the meniscus vibrating periods v1, v2, . . . can be varied by changing the number of drive waveforms to be selected.

In this way, in the recording apparatus, both the drive waveforms for the flushing periods f1, f2, . . . and the meniscus vibrating periods v1, v2, . . . can be generated with one drive signal generated from one drive signal generator 27, resulting in less complex apparatus with easier control.

Also, in the recording apparatus, the operation conditions for the flushing periods f1, f2, . . . and the meniscus vibrating periods v1, v2, . . . are changed depending on the stand-by time from the scan stop to the scan start of the recording head 1 that is measured by the stand-by timer 30, or the kind of ink to be ejected.

That is, in this example, the vibrating number in the meniscus vibrating periods v1, v2, . . . is set at 100 times in a range where the stand-by time is 2 sec or less, and the number of ejected droplets in the flushing periods f1, f2, . . . is set at 200 shots for the black ink that is relatively likely to be viscous, or 50 shots for the color ink that is relatively unlikely to be viscous, as shown in FIG. 7.

Also, in a range where the stand-by time is from 2–12 sec, the vibrating number in the meniscus vibrating periods v1, v2, . . . is set at 1000 times, and the number of ejected droplets in the flushing periods f1, f2, . . . is set at 400 shots for the black ink, or 100 shots for the color ink. Further, in a range where the stand-by time exceeds 12 sec, the recording head 16 is moved back to a location of the cap 23 to seal the nozzle orifices 8, and kept waiting.

In this way, the number of ejected droplets in the flushing periods f1, f2, . . . or the vibrating number in the meniscus vibrating periods v1, v2, . . . is varied in accordance with the length of stand-by time period, and the number of ejected droplets in the flushing periods f1, f2, . . . is increased for the black ink that is likely to be viscous. Therefore, the viscous ink is diffused and the number of ejected droplets is increased in accordance with the degree of viscosity owing to the stand-by, whereby the viscous ink can be surely expelled. The vibrating number in the meniscus vibrating periods v1, v2, . . . may be varied in accordance with the kind of ink to be ejected.

In this way, with the ink jet recording apparatus, the viscous ink near the nozzle orifices 8 can be diffused and effectively expelled in the flushing periods f1, f2, . . . or the meniscus vibrating periods v1, v2, . . . that involves the intermittent flushing operation. Accordingly, an unstable ejection such as flight curvature is unlikely to occur in the subsequent ejecting, and an ejection failure caused by the bubbles entering the nozzle orifices 8 is less likely to occur.

FIG. 8 is a diagram showing a second embodiment of the flushing operation of the invention. The second embodiment is the same as the first embodiment, except that the recording apparatus does not have the meniscus vibrating periods v1, v2, . . . that involves the meniscus vibrating operation, and effects only the flushing periods f1, f2, . . . that involves the intermittent flushing operation. Herein, the intermittent flushing operation involves ejecting plural ink droplets successively with a predetermined interval (with a longer period than an ink droplet ejection period during the flushing period). With this recording apparatus, the ink near the nozzle orifices 8 resides and vibrates between each flushing period f1, f2, . . . , causing the viscous ink to be diffused to some extent and more likely to be expelled.

In the above embodiments, the meniscus vibration waveform in the meniscus vibrating operation that arises during the meniscus vibrating periods v1, v2, . . . involves applying a drive voltage not to eject ink droplets to the piezoelectric vibrator 6. However, this invention is not limited thereto, but the meniscus vibration waveform may be such that the voltage gradient while charging or discharging does not cause ink droplets to be ejected.

In the above embodiments, this invention is applied to the flushing operation in which the recording head 16 restarts the printing from the stand-by state. However, this invention is not limited thereto, but may be applied to the flushing operation in which the recording apparatus in suspension restarts the printing, or the flushing operation which is performed every time a predetermined amount of print data is processed.

In the above embodiments, this invention is applied to an ink jet recording apparatus having a recording head 16 employing a piezoelectric vibrator 6 of the longitudinal vibration mode. However, this invention is not limited thereto, but may be applied to a recording apparatus having a recording head employing a piezoelectric vibrator of the flexural oscillation mode or a bubble jet recording head employing a heating element for vaporizing the ink within the channel as a pressure generating element. In these cases, the same effects can be obtained.

What is claimed is:

1. An ink jet recording apparatus, comprising:

a recording head including a nozzle orifice communicated with a pressure generating chamber;

a pressure generator, which varies pressure of ink in the pressure generating chamber; and a controller, which drives the pressure generator to eject ink droplets from the nozzle orifice such that a plurality of first operations and a plurality of second operations are alternately repeated in one flushing operation when a recording operation of the recording head is not performed, wherein:

each of the first operations includes a plurality of repetitive drivings of the pressure generator each of which is performed such that a meniscus of ink is vibrated to an extent that an ink droplet is not ejected from the nozzle orifice; and each of the second operations includes a plurality of repetitive ink ejections.

2. The ink jet recording apparatus as set forth in claim 1, wherein an ejection frequency in a final one of the second operations is higher than an ejection frequency in an initial one of the second operations.

3. The flushing control method as set forth in claim 2, wherein an ejection frequency in a latter one of the second operations is higher than an ejection frequency in a former one of the second operations.

4. The flushing control method as set forth in claim 1, wherein the repeated number of ink ejection in a final one of the second operations is greater than the repeated number of ink ejection in an initial one of the second operations.

5. The flushing control method as set forth in claim 4, wherein the repeated number of ink ejection in a latter one of the second operations is greater than the repeated number of ink ejection in a former one of the second operations.

6. The ink jet recording apparatus as set forth in claim 1, wherein the pressure generator is driven at the maximum driving frequency thereof to vibrate the meniscus of ink.

7. The ink jet recording apparatus as set forth in claim 1, wherein an initial one of the first operations is performed before an initial one of the second operations is performed.

8. The ink jet recording apparatus as set forth in claim 1, wherein:

the recording head performs the recording operation while moving in a first direction; and the second operations are performed when the recording head is in a stand-by state which is defined as a time period from when the recording head stops moving to when the recording head starts moving.

9. The ink jet recording apparatus as set forth in claim 8, further comprising a timer, which measures a time period of the stand-by state, wherein the repeated number of ink ejections in each of the second operations is determined in accordance with the measured stand-by time period.

10. The ink jet recording apparatus as set forth in claim 1, wherein the repeated number of ink ejection in each of the second operations is determined in accordance with a type of ejected ink.

11. The ink jet recording apparatus as set forth in claim 1, wherein a vibrating number of the pressure generator in each of the first operations is determined in accordance with a type of ejected ink.

12. The ink jet recording apparatus as set forth in claim 1, wherein the pressure generator is a piezoelectric vibrator which changes the volume of the pressure generating chamber to vary the pressure of ink therein.

13. The ink jet recording apparatus as set forth in claim 1, wherein the controller includes:

a drive signal generator, which generates a common drive signal including a first waveform configured to perform the first operations and a second waveform configured to perform the second operations; and a drive waveform selector, which applies the first waveform and the second waveform selectively to the pressure generator.

* * * * *